United States Patent [19]

Iizuka et al.

[11] Patent Number: 5,063,864

[45] Date of Patent: Nov. 12, 1991

[54] WORKPIECE STACKER IN SEWING MACHINE

[75] Inventors: Tetsuo Iizuka; Tokiji Jin; Hideho Sasamoto, all of Chofu, Japan

[73] Assignee: Juki Corporation, Tokyo, Japan

[21] Appl. No.: 581,769

[22] Filed: Sep. 13, 1990

[51] Int. Cl.[5] ..... D05B 33/00

[52] U.S. Cl. ..... 112/121.29; 271/175

[58] Field of Search ..... 112/121.29; 271/175, 271/85

[56] References Cited

U.S. PATENT DOCUMENTS

| | | | |
|---|---|---|---|
| 3,704,884 | 12/1972 | Nicolay et al. | 112/121.29 X |
| 3,712,609 | 1/1973 | Robert | 271/175 |
| 3,788,248 | 1/1974 | Marforio | 112/121.29 |
| 3,808,993 | 5/1974 | Heiler et al. | 112/121.29 X |
| 4,067,272 | 1/1978 | Marforio | 112/121.29 |
| 4,608,938 | 9/1986 | Bisson | 112/121.29 |
| 4,788,438 | 10/1988 | Tastavin et al. | 112/121.29 |

FOREIGN PATENT DOCUMENTS

| | | |
|---|---|---|
| 0046492 | 7/1981 | European Pat. Off. . |
| 2101506 | 7/1971 | Fed. Rep. of Germany . |
| 2229002 | 12/1972 | Fed. Rep. of Germany . |
| 199376 | 12/1962 | Japan . |
| 1274795 | 11/1989 | Japan . |
| 1216740 | 6/1968 | United Kingdom . |
| 1302978 | 1/1973 | United Kingdom . |

*Primary Examiner*—Werner H. Schroeder
*Assistant Examiner*—Paul C. Lewis
*Attorney, Agent, or Firm*—Morgan & Finnegan

[57] ABSTRACT

A plurality of workpieces, hanging from a sewing machine, are stacked on a workpiece stacking panel in such a manner that the lower end each of the workpiece is clamped on a workpiece draping cylinder by a first swingable clamping member and the intermediate portion thereof is thrown by a workpiece throw-over member and turned over the draping cylinder. A second swingable clamping member is provided under a working table to clamp the topmost workpiece on the stacking panel. The stacking panel is adapted for gradual downward movement according to quantity of the workpieces to be stacked on the panel.

2 Claims, 3 Drawing Sheets

WORKPIECE STACKER IN SEWING MACHINE

BACKGROUND IN THE INVENTION

This invention relates to a workpiece stacker, and more particularly to a workpiece stacker adapted to stack workpieces as sewed above a panel.

As is well known to those skilled in the art, there have in the past been proposed workpiece stackers of the type shown in FIG. 5 and illustrated in Japanese Laid Open Utility Model Publication No. Hei 1-99376. In such earlier stacker systems, a first workpiece clamping member 2 and a workpiece throw-over member 3 beneath a sewing machine were adapted to have forward ends 2*b*, 3*b* thereof rotated about pivot points 2*a*, 3*a*. A bed or panel 6 is mounted on a pipe or rod 5 which is disposed downwardly of a working table 4 and is supported by a machine frame 7. A second fabric clamping member 8 is provided downwardly of the working table 4 to have its forward end 8*b* rotated about a pivot point 8*a*. Rotation of the forward end 8*b* of the workpiece clamping member 8 is in association with the first workpiece.

The conventional workpiece stacker arranged as aforementioned is designed so that the first workpiece clamping member is rotated about the pivot point 2*a* to abut or press a marginal edge of a workpiece 9 suspended from the bed of the sewing machine 1 against the rod 5 as shown by a dotted line in FIG. 5.

In association with the rotation of the first workpiece clamping member 2, the second workpiece clamping member 8 is rotated upwardly to move the forward end 8*b* of the second workpiece clamping member 8 to the position shown by a dotted line in FIG. 5. The workpiece throw-over member 3 is caused to rotate its forward end 3*b* about the pivot point 3*a* to urge the intermediate or medium portion of the workpiece 9 to turn over the upper end of the workpiece 9 on the rod 5. The forward end 3*b* of the workpiece throw-over member 9 is moved in turn as shown by a dotted line above a stacker 6 so that the workpieces 9 are stacked on the rod 5 and the stacker 6. The first workpiece clamping member 2 and the throw-over member 3 are then returned to initial positions. As the first workpiece clamping member 2 is rotated, the second workpiece clamping member 8 is returned to its position as shown in solid line to urge the stacked workpieces 9.

As mentioned above, in the conventional workpiece stacker of FIG. 5, the rod 5 is rigidly mounted on the underside of the working table 4 so that the number of the workpieces 9 to be stacked is determined by the distance between the working table 4 and the rod 5, and the distance between the rod 5 and the first workpiece clamping member 2 and the workpiece throwover member 3. To increase the number of the workpieces 9 to be stacked, the workpiece draping rod or bar 5 is mounted in a lower position or kept away form the clamping member 2 and the throw-over member 3. As a resultant draw-back, the workpiece, if it is of a short length, is hung from the sewing machine 1 and is neither draped over nor stacked properly.

SUMMARY OF THE INVENTION

It is an object of the invention to provide a workpiece stacker for sewing machines which avoids the disadvantages of the prior art and enables a plurality of workpiece sheets to be stacked thereon irrespective of the size of the workpiece or the existence of particular features, such as pockets or pocket flaps.

The aforementioned and other objects of the invention are accomplished by providing a workpiece stacker for sewing machines including a vertically moving stacking panel in accordance with the invention. A sewing machine system incorporating the invention can include a sewing machine bed, a sewn workpiece hung from the bed, a working table of the sewing machine, a workpiece draping cylinder provided downwardly of the working table, and a workpiece stacking panel. Also provided are a first workpiece clamping member adapted for rotation and to transversely clamp a lower end of the workpiece against the draping cylinder, and a workpiece throw-over member for throwing the intermediate or medium portion of the workpiece to turn the latter over on the draping cylinder, urging the workpiece against the stacking panel. A second workpiece clamping member is located under the working table and is actuated to push the workpiece at the top thereof to be held over the stacking panel.

The workpiece stacker arranged as aforementioned is further characterized in that the stacking panel is mounted so as to be downwardly moved by the second workpiece clamping member and is held stationary by a support means mounted on the stacking panel. The stacking panel is continuously and gradually moved downwardly by the weight of the stacked workpieces and is in turn moved upwardly by a spring upon releasing a support lever of the support mechanism.

According to preferred embodiments of the invention, first and second air blow pipes are provided downwardly of the workpiece draping cylinder and at the underside of the working table. The first air blow pipe is adapted to jet air therefrom to blow up the workpieces on the draping cylinder. The second air blow is arranged to jet air therefrom for stacking the blown workpiece on the stacking panel.

A functional advantage of the invention is that the first workpiece clamping member is pivotally moved to allow the forward end of the first clamping member to transversely hold the lower end portion of the sewn workpiece on the workpiece draping cylinder. With pivotal movement of the first clamping member, the forward end of the second clamping member is raised and the throw-over member is oscillated to allow the forward end thereof to slide over the intermediate or medium portion of the workpiece and then to turn over the workpiece on the draping cylinder, pushing the upper end of the workpiece to the top of the workpiece stacking panel. Thereafter, the throw-over assumes its initial position to allow the forward end of the second clamping member to hold the workpiece.

Thus, the first clamping member assumes its initial position to permit the forward end of the second clamping member to hold the workpiece. At the same time, the first air blow pipe blows up the workpiece handing over the draping cylinder whereas the second air blow pipe mounted under the working table blows down the workpiece to stack the same on the stacking panel.

BRIEF DESCRIPTION OF THE DRAWINGS

The invention will now be described, by way of example only, with reference to the accompanying drawings, in which.

DETAILED DESCRIPTION OF THE DRAWINGS

Figure 1:
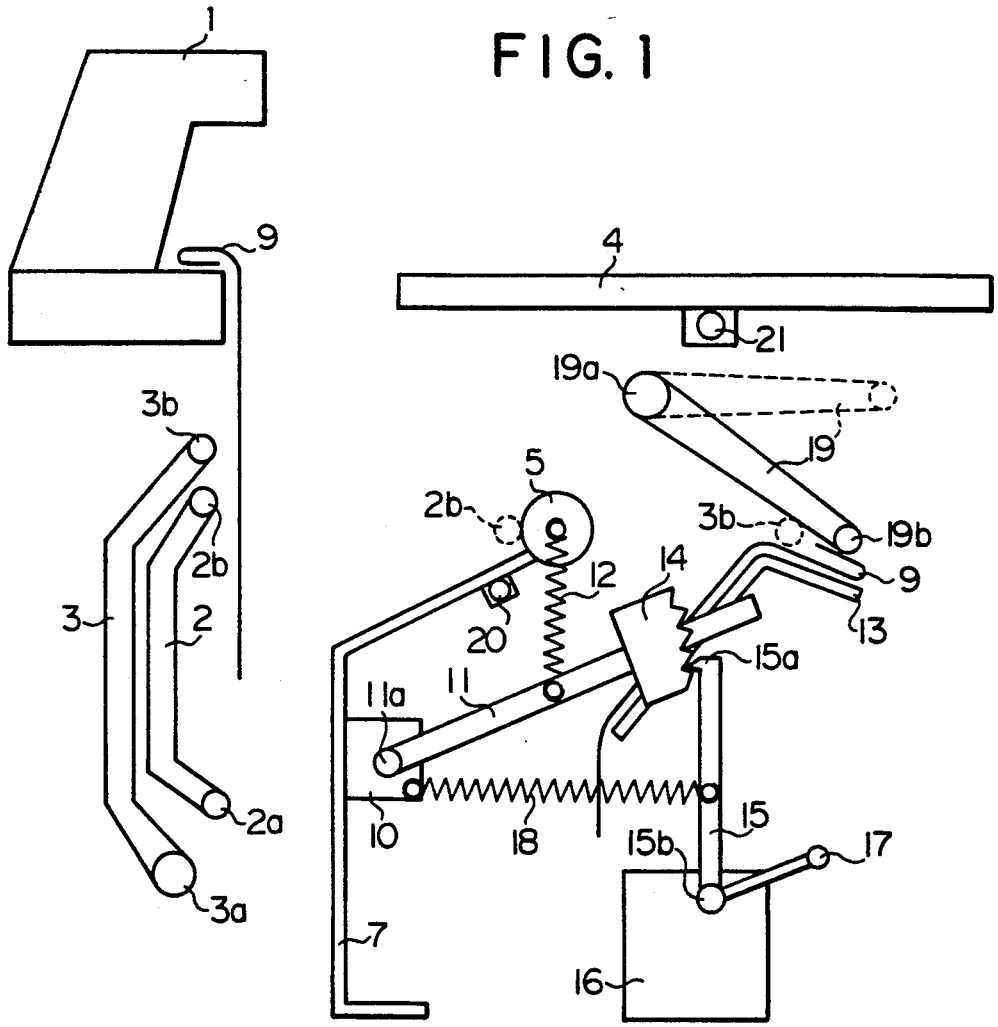
FIG. 1 is schematic view showing a workpiece stacker in a sewing machine according to a preferred embodiment of the invention.

Referring to FIG. 1, a workpiece stacker embodying the present invention is shown as being used with a sewing machine 1. As is similar to the conventional workpiece stacker shown as the prior art in FIG. 5, the workpiece stacker includes a first workpiece clamping member 2, a workpiece throw-over member 3, axles 2*a*, 3*a*, a working table 4, a workpiece draping cylinder 5, and a frame 7.

In the instant embodiment of the present invention, however, a bracket 10 is secured to the frame 7 and includes an arm 11. One end 11*a* of the arm 11 is pivotally mounted to the bracket 10. The arm 11 is upwardly urged by a spring 12, one end of which is connected to the shaft of the draping cylinder 5.

A workpiece stacking panel 13 is fixed to one end of the arm 11 one side of which is provided with a rack 14 engageable with a pawl 15*b* of a lever 15. A spring 18 is interposed between a mid-portion of the lever 15 and the bracket 10 to allow the pawl 15*a* of the lever 15 to normally engage the rack 14.

Figure 5:
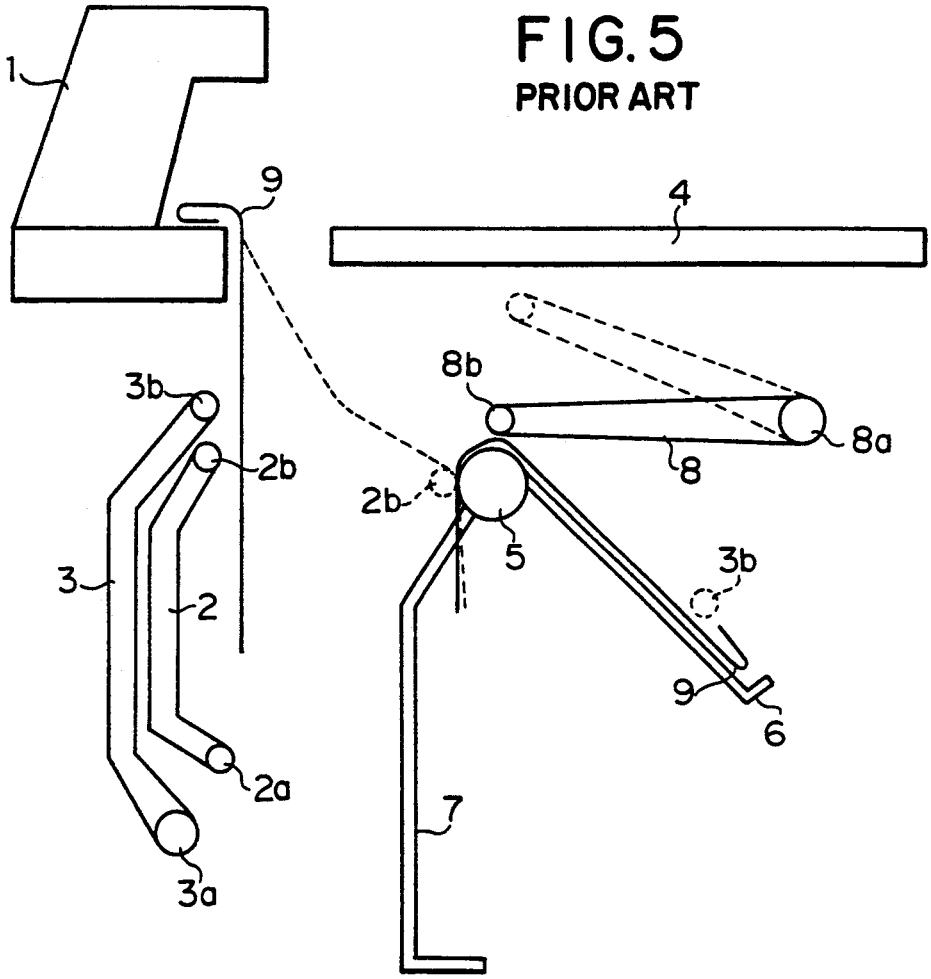
FIG. 5 PRIOR ART
FIG. 5 is a schematic view showing a conventional workpiece stacker.

A second workpiece clamping member 19 is reoriented in a direction opposite to that of the second clamping member 8 of the conventional workpiece stacker shown in FIG. 5. More specifically, the second clamping member 19 has an axle 19*a* immediately under the working table 4 so that the forward end of the clamping member 19 is swung between the upper portion of the stacking panel 13 and the lower portion of the working table 4. A first air blow pipe 20 is mounted on the frame 7 adjacent the draping cylinder 5 whereas second air blow pipe 21 is disposed on the underside of the working table 4 adjacent the axle 19*a* of the second clamping member 19.

Figure 2:
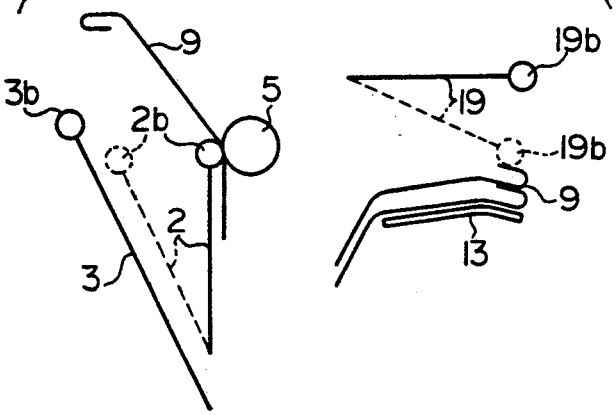
FIGS. 2, 3 and 4 are explanatory representations of the manner in which the workpieces are stacked by the workpiece stacker shown in FIG. 1.

The operation of the workpiece stacker will now be described with reference to FIGS. 2, 3 and 4. As seen from FIG. 2, the lower end of the sewn workpiece 9 is pushed by the forward end 2*b* of the first workpiece clamping member 2 which then transversely urges the same to the draping cylinder 5. Simultaneously with pushing movement of the first clamping member 2, the forward end 19*b* of the second clamping member 19 is raised.

Figure 3:
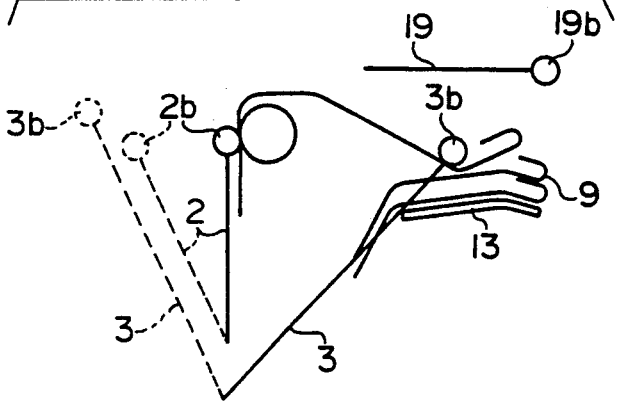

As shown in FIG. 3, the workpiece 9 is pushed ranging from its central portion to the upper portion by the forward end 3*b* of the throw-over member 3 and is then turned over by the draping cylinder. The workpiece is held against the stacking member 13 by the swinging movement of the throw-over member.

Figure 4:
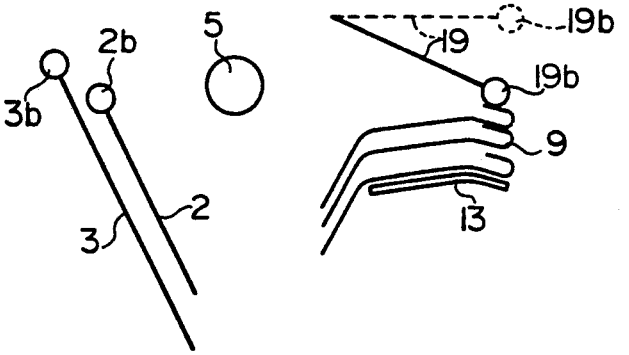

As is apparent from FIG. 4, the workpiece 9 is clamped by the second clamping member at the forward end thereof 19*b* as lowered at the moment the forward end 3*b* of the throw-over member 3 assumes its initial position. Subsequently, the forward end 2*b* of the first clamping member 2 assumes its original position.

At this time, the workpiece, being draped over the draping cylinder 5 and the stacking panel 13, is blown upwards at its lower end by the first air blow pipe 20 and downward at its intermediate portion by the second air blow pipe 21 to stack the workpiece on the stacking panel 13.

When the workpieces are stacked in this manner on the stacking panel, to some extent the stacking member 13 is lowered against the bias of the spring 12 by a distance corresponding to the thickness of the workpieces stacked on the panel due to downward movement of the forward end 19*b* of the second clamping member 19 for pushing down the workpieces. The pawl 15*b* of the lever 15 is now caused to mesh with the next teeth of the rack 14. When the stacking panel is lowered to its full extent by stacking the workpieces 9 on the stacking panel to a certain extent, the second clamping member may be raised by a manual change-over valve (not shown) for conveying the workpieces.

In this connection, it is noted that the stacking panel is supported on a support mechanism which including rack 14 and lever 15, thereby preventing the stacking panel from suddenly jumping up by the action of the spring. Accordingly, after the workpieces 9 have been all conveyed, the claw 15*b* of the lever is disengaged from the rack 14 by pulling the handle bar 17 forward so that the stacking panel 13 assumes its initial position by the bias of the spring 12.

In this embodiment, when the workpieces 9 are stacked to some extent, the stacking panel is gradually lowered by the second clamping member 19 to thus enable a greater quantity of workpieces to be stowed on the stacking panel 13.

The workpiece stacker as arranged according to the disclosed embodiments of the invention is advantageous in that the stacking panel is lowered by a distance corresponding to the thickness of the workpieces as stacked by the second clamping member. The stacking member is supported by the support mechanism when desired and is capable of stacking more workpieces than the conventional workpiece stacker in good order.

Although the invention has been described in detail with reference to the disclosed embodiments, it should be understood that the invention is not limited to the disclosed embodiments but should be interpreted in accordance with the claims which follow.

We claim:

1. A workpiece stacker for a sewing machine having a workpiece table, comprising:

a stacking panel for stacking thereon a workpiece;

means for receiving thereon a lower end of said first workpiece;

first means for pushing the lower end of said workpiece to said receiving means to clamp the workpiece between said receiving means and said first pushing means;

means for transporting a middle portion of said workpiece on said stacking panel;

second means provided under said workpiece table for pushing an upper end of said workpiece to said stacking panel;

means for supporting said stacking panel so that said stacking panel continuously and gradually moves downward as said second pushing means pushes the workpiece to said stacking panel; and means for moving said stacking panel to an initial position;

wherein said supporting means comprises a supporting lever rotatably mounted on said sewing machine and means for allowing downward movement of said stacking panel while restricting upward movement thereof;

wherein said allowing means comprises a rack mounted on said supporting lever and a lever mounted on said sewing machine, said lever including a pawl engaging with said rack.

2. A workpiece stacker as set forth in claim 1, wherein said means for moving said stacking panel comprises a spring for urging upwardly said supporting lever and a handle bar for releasing said pawl from said rack.

* * * * *